United States Patent [19]

Lawson

[11] Patent Number: 4,650,965

[45] Date of Patent: Mar. 17, 1987

[54] RADIANT HEAD-HEATING APPARATUS

[76] Inventor: John W. Lawson, #5 Red Mill Ct., St. Charles, Mo. 63303

[21] Appl. No.: 765,728

[22] Filed: Aug. 15, 1985

[51] Int. Cl.[4] ..... H05B 3/20; A47C 21/00

[52] U.S. Cl. ..... 219/345; 5/421; 128/376; 219/217; 219/342

[58] Field of Search ..... 219/217, 342, 345, 354, 219/526, 527, 347; 128/376; 5/421, 422, 423, 508

[56] References Cited

U.S. PATENT DOCUMENTS

| | | | |
|---|---|---|---|
| 558,394 | 4/1896 | Kellogg | 128/376 |
| 1,326,133 | 12/1919 | Kinosita | 219/342 |
| 1,376,593 | 5/1921 | Tuttle | 219/354 |
| 1,891,595 | 12/1932 | Grierson | 219/345 |
| 2,209,801 | 7/1940 | Valverde | 219/342 |
| 2,458,901 | 1/1949 | Fields | 219/354 |
| 2,579,964 | 12/1951 | Reynolds | 219/526 |
| 2,649,530 | 8/1953 | Dietz | 219/345 |
| 3,260,835 | 7/1966 | Soukey et al. | 219/345 |
| 3,438,069 | 4/1969 | Long | 5/422 |
| 3,499,232 | 3/1970 | Zimmermann | 219/345 |
| 3,646,319 | 2/1972 | Auld | 219/354 |
| 3,750,672 | 8/1973 | von Berckheim | 128/376 |
| 4,027,344 | 6/1977 | Pak | 219/217 |
| 4,354,091 | 10/1982 | Bain | 219/217 |
| 4,471,212 | 9/1984 | Hager, Jr. | 219/345 |
| 4,590,940 | 5/1986 | Pigmans | 128/376 |
| 4,600,009 | 7/1986 | Kramer et al. | 128/376 |
| 4,602,486 | 7/1986 | Weinstein | 5/421 |

FOREIGN PATENT DOCUMENTS

| | | | |
|---|---|---|---|
| 2910865 | 10/1980 | Fed. Rep. of Germany | 5/421 |
| 342684 | 1/1931 | United Kingdom | 219/345 |

*Primary Examiner*—A. D. Pellinen
*Assistant Examiner*—Geoffrey S. Evans
*Attorney, Agent, or Firm*—Richard G. Heywood

[57] ABSTRACT

A heating apparatus to heat the pillow area of a bed including a radiant heater panel having a mounting frame to position the panel in superposed relation to such pillow area, and an electric controller for regulating the temperature of the heater panel.

11 Claims, 3 Drawing Figures

RADIANT HEAD-HEATING APPARATUS

BACKGROUND OF THE INVENTION

The invention pertains to heating apparatus, and more particularly to a radiant head-heating apparatus especially adapted to provide a warm localized environment in the pillow area of a bed.

In the past various devices have been available for localized or area heating including various types of radiant space heaters and room warmers and, in the case of sleeping accommodations, various electric blankets and bed warmers have been devised. Miller et al U.S. Pat. No. 3,961,157 shows a portable, radiant, electric resistance, heater panel for warming the feet and legs of an individual to increase their general comfort and efficiency such as when working at a desk in a cool ambient environment. Ellison U.S. Pat. No. 3,612,823 shows a portable device in the combined form of a decorative picture and electric room-heating panel. Moss U.S. Pat. No. 4,455,472 teaches a bed warming device disposed beneath a bed for heating the entire bed as an alternative to conventional electric blankets laid on top of the bed sheet as a heated cover, and Berckhelm U.S. Pat. No. 3,750,672 is of interest in suggesting an arrangement for creating an artificial electrostatic field in the head region of a bed simulating a health inducing electrostatic field naturally occurring in the open air. Thus, while warmth, comfort, health and general well-being have been a continuing concern, the art does not teach a head-heating apparatus for localized heating of a person's head in the pillow area of a bed in the cool ambient environment of a bedroom.

It should be recognized that a great deal of body heat can be lost from the head as is well-known in the head-wear field. In addition to improved personal comfort during sleep, it has been discovered that such a head-heating apparatus can prevent or relieve the stress of sinus headache.

SUMMARY OF THE INVENTION

The present invention is embodied in a head-heating apparatus having a radiant heat panel positioned in superposed relation with the pillow area of a bed for controllably heating same, including means for mounting the heat panel in such position, and means for regulating the temperature of the heat panel, including ambient compensated controller means.

The principal object of the present invention is to provide radiant heating means for controllably heating the pillow area of a bed to obviate heat loss from a person's head when sleeping in a cool ambient atmosphere.

Another object is to provide a non-illuminating radiant heating means to maintain a warm pillow zone and increase personal comfort during sleep.

Another object is to provide a selectively heated comfort zone while permitting energy savings by reducing general household heating.

Still another object is to provide a head-heating means for relieving the effect of sinus headache attributable to cold air exposure.

Another object is to provide a radiant heating means for heating the pillow area of a bed in a safe, silent, efficient and economical manner.

These and still other objects and advantages will become more apparent hereinafter.

DESCRIPTION OF THE DRAWINGS

The invention is embodied in the parts and in the combinations and arrangements of parts hereinafter described and claimed. In the accompanying drawings which form a part of this specification and wherein like numerals refer to like parts wherever they occur:

DESCRIPTION OF THE PREFERRED EMBODIMENT

Figure 1:
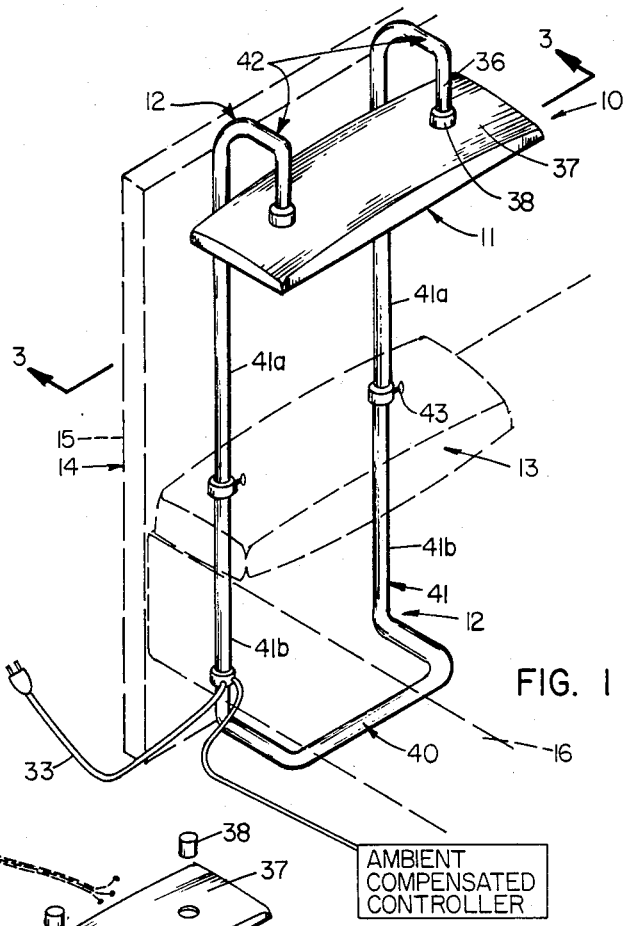
FIG. 1 is a diagrammatic view of a radiant head-heating apparatus embodying the invention and showing the pillow area of a bed in broken lines for environmental purposes.

Referring now to the drawings, a radiant head-heater apparatus 10 embodying the invention includes an elongated heater panel assembly 11 and a supporting or mounting frame assembly 12 therefor, which is free-standing in its preferred form. As shown in FIG. 1, the radiant heating apparatus 10 is oriented in a superposed position over the pillow area 13 of a bed 14 having a headboard 15 and mattress 16, all shown in broken lines for purposes of illustrating the environment of the bed and its pillow area 13.

Figure 2:
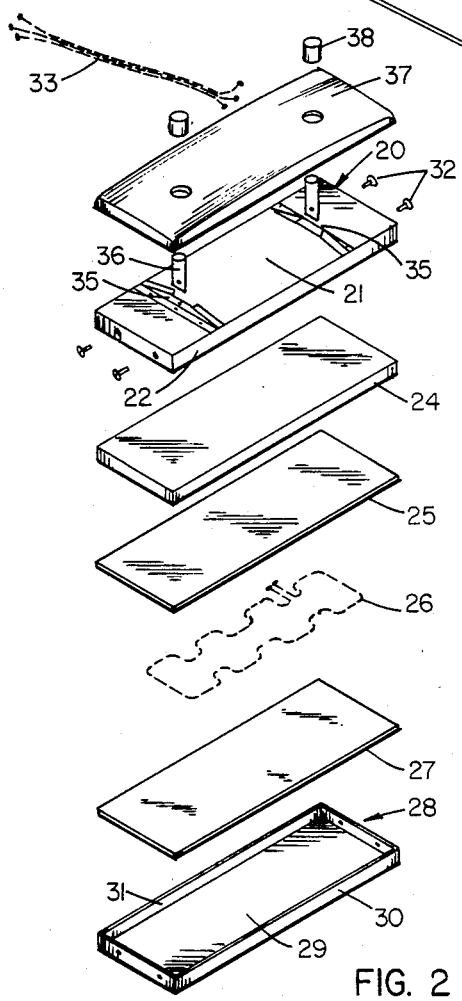
FIG. 2 is an exploded view of the heat panel used in the present invention.

The structure of the radiant heater panel 11 is shown best in FIG. 2 and comprises a top housing member 20 having an imperforate top wall 21 and peripheral side walls 22 defining a recessed interior 23 for housing the heater assembly components, which sequentially include a relatively thick insulating blanket or sheet of foil-backed fiberglass or like insulating material 24, a second sheet of electrical insulating material 25 such as asbestos, a resistance heater 26, a third sheet of electrical insulating material 27 and a bottom housing member or heat transfer panel 28 having an imperforate bottom wall 29 and peripheral side walls 30 defining a recessed interior 31. In the heater assembly the resistance heater 26 is sandwiched between the two relatively thin asbestos layers 25 and 27 to maintain electrical integrity from the metal housing members 20 and 28, and the fiberglass insulating panel 24 acts to further shield the top member 20 and direct the radiating heat downwardly to the heat transfer panel 28. Thus, the assembly is contained within the recessed interiors 23 and 31 of the top and bottom members 20 and 28, which are interfit together with the bottom panel side walls 30 being confined by the upper member side walls 22 and secured together by metal screws 32 or the like.

The electrical resistance heater 26 comprises a continuous length of resistance wire having a preselected maximum capacity of about 100 watts operable on conventional 115 volt house current and produces a maximum surface temperature of 156° F. on the heat transfer panel 28. The resistance heater 26 is wired by UL approved appliance wire 33 extending exteriorly of the panel assembly 11, and preferably through the mounting assembly 12, as will appear.

Figure 3:
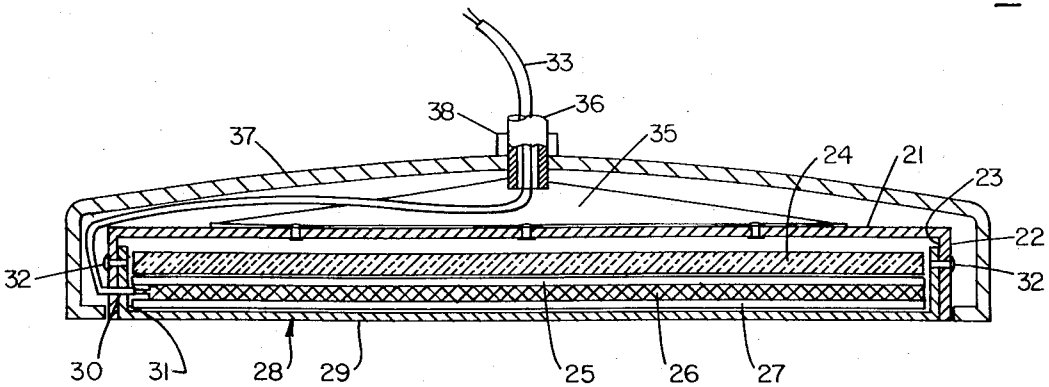
FIG. 3 is a greatly enlarged cross-sectional view taken substantially along line 3—3 of FIG. 1.

The heater assembly 11 includes mounting means for attaching it to its supporting frame assembly 12. As shown in FIGS. 2 and 3, the top wall 21 of the upper frame member 20 has a pair of upstanding spaced mounting brackets 35 to which a pair of vertical posts 36 are bolted. A decorative exterior dust cover 37 of plastic material or the like may be provided to encase the entire heater panel assembly 11 and lead wiring 33 therefor, and this cover 37 may be held in place on the vertical posts 36 by sleeves 38 secured by set screws or the like.

The mounting frame assembly 12, FIG. 1, preferably is free-standing and includes a tubular frame having a U-shaped floor section 40, spaced vertical legs or stanchions 41 and forwardly projecting L-shaped mounting arms 42 secured to or integral with the vertical posts 36. The legs 41 may have telescoped upper and lower members **41*a* and 41*b* releasably secured by winged set screws 43 for providing height adjustment of the heater panel assembly 11 relative to the floor. It will be apparent that the mounting assembly 12 may be modified for attachment directly to the headboard 15 of the bed 14, but the preferred embodiment permits the entire apparatus 10** to be readily moved to different locations for use if necessary or desired.

The electrical lead wire 33 may be contained within the tubular frame assembly 12 from the heater assembly 11 to a location near the floor where an electrical house receptacle (not shown) is usually located, or the lead wire 33 may extend out of the cover 37 and be attached to the exterior tubing surface by clips or tape (not shown) in order to facilitate field assembly of the apparatus. This lead wire 33 is provided with temperature control means 45 for regulating the operating temperature of the heater panel 11, which may be in the form of a manually operated off-on and rheostat control such as is used for conventional electric blankets or, preferably, the temperature control means 45 may be a variable ambient compensated controller of the type employing an internal bi-metal heat switch (not shown) that modulates between an open and closed contact condition to maintain the heating element 26 at a substantially constant temperature irrespective of ambient room temperature. It should be noted that an ambient compensated controller 45 should be positioned on the floor under the bed 14 or at any location that is directly exposed to the room ambient where the controller will not be effected by the radiated heat from the heater panel assembly 11. If the controller 45 is a rheostatic device that variably controls the temperature of the heater panel assembly 11, it will be located under the pillow 13 or wherever it can be conveniently reached.

In operation, the radiant head-heater apparatus 10 is positioned in superposed position over the pillow area 13 to be heated and the lead wire 33 is plugged into the household power receptacle (not shown). The resistance heater 26 is operated by the temperature controller 45 to maintain a constant heat radiation temperature of about 156° F. on the lower radiant heat panel 29 as a safe and non-illuminating heat source for the pillow area 13. It is apparent that the heater 10 may supplement other body heating means, such as a thermal or electric blanket, and creates a comfort zone for the person's head which heretofore has normally been directly exposed to the ambient room temperature.

The invention is intended to cover changes and modifications that will be apparent to those skilled in the art, and is only limited by the scope of the appended claims.

What is claimed is:

1. A radiant head-heating apparatus comprising a non-illuminescent radiant heater panel sized to heat only the head of a person resting on the pillow area of a bed, electric controller means regulating the temperature of said heater panel, and mounting means mounting said heater panel in superposed and spaced position directly over the pillow area of a bed.

2. The head-heating apparatus according to claim 1, in which said radiant panel comprises a main housing member, an electric heating element contained within said housing member, and a front heat transfer panel enclosing said heating element within said housing member, said heat transfer panel receiving thermal energy from said heating element and being directly exposed to the said pillow area for heating the space thereabove.

3. The head-heating appartus according to claim 2, in which said heating element is a resistance-type heater, and said radiant panel includes insulating material constructed and arranged to electrically insulate said heating element from said housing member and heat transfer panel and to provide primary transfer of radiant energy from said heating element to said heat transfer panel.

4. The head-heating apparatus according to claim 1, in which said mounting means comprises at least one first frame member adapted to project horizontally and downwardly from the headboard of a bed, and said radiant heater panel including a substantially planar heat transfer surface mounted by said first frame member in a horizontal position above said pillow area.

5. The head-heating apparatus according to claim 4, in which said mounting means also comprises a movable self-supporting frame that is free standing and includes vertical stanchion means adapted to be positioned behind the headboard of a bed, and said first frame member is connected to said stanchion means to project forwardly and downwardly therefrom.

6. The head-heating apparatus according to claim 4, in which said mounting means also comprises vertical stanchion means, and said first frame member includes a vertical leg that is adjustable relative to said vertical stanchion means for adjusting the vertical height of said first frame member relative to the plane of said pillow area.

7. The head-heating apparatus according to claim 1, in which said electric controller means comprises an ambient temperature responsive controller for maintaining a substantially uniform temperature on said radiant heater panel.

8. The head-heating apparatus according to claim 1, in which said temperature regulating means comprises a manually operated rheostat control for selectively regulating the temperature on said radiant heater panel.

9. A radiant head-heating apparatus in combination with a bed having a mattress with a headboard at one end and a pillow area immediately adjacent thereto; said head-heating apparatus comprising a radiant heater panel having a main housing member and an electric heating element contained therein, a non-illuminescent heat transfer panel closing said housing member and receiving thermal energy from said heating element, means insulating said heating element from electrical contact with said housing member and heat transfer panel, temperature regulating means operating said heating element to maintain a substantially constant temperature on said heat transfer panel, and mounting means positioned behind and over the headboard mounting said radiant heater panel in superposed relation directly over the pillow area to heat the head of a person resting on the pillow area with said heat transfer panel being in a substantially horizontal and spaced position for radiating heat only onto said pillow area.

10. The head-heating apparatus according to claim 9, in which said heating element comprises a resistance heater of preselected capacity, and said temperature regulating means comprises an ambient compensated controller for modulating the operation of said heater to maintain the constant temperature thereof on said heat transfer panel.

11. The head-heating apparatus according to claim 9, in which said heating element comprises a resistance heater of preselected maximum capacity, and said temperature regulating means comprises a manually operated rheostat control for variably regulating the temperature on said heat transfer panel.

* * * * *